US010794090B2

(12) United States Patent
Park et al.

(10) Patent No.: US 10,794,090 B2
(45) Date of Patent: Oct. 6, 2020

(54) INPUT DEVICE FOR DOOR LOCK

(71) Applicant: AMADAS Co., LTD, Seoul (KR)

(72) Inventors: Eun-Min Park, Seongnam-si (KR); Sang-Woo Jung, Busan (KR); Gi-Young Kim, Anyang-si (KR)

(73) Assignee: AMADAS CO., LTD., Seoul (KR)

( * ) Notice: Subject to any disclaimer, the term of this patent is extended or adjusted under 35 U.S.C. 154(b) by 101 days.

(21) Appl. No.: 16/070,517

(22) PCT Filed: Jan. 21, 2016

(86) PCT No.: PCT/KR2016/000683
§ 371 (c)(1),
(2) Date: Jul. 16, 2018

(87) PCT Pub. No.: WO2017/126723
PCT Pub. Date: Jul. 27, 2017

(65) Prior Publication Data

US 2019/0368230 A1 Dec. 5, 2019

(51) Int. Cl.

| | |
|---|---|
| ***E05B 49/00*** | (2006.01) |
| ***E05B 1/00*** | (2006.01) |
| ***E05B 63/04*** | (2006.01) |
| ***G07C 9/00*** | (2020.01) |

(52) U.S. Cl.
CPC ..... *E05B 49/00* (2013.01); *E05B 1/003* (2013.01); *E05B 63/04* (2013.01); *G07C 9/00817* (2013.01); *E05Y 2900/132* (2013.01)

(58) Field of Classification Search
CPC ..... E05B 1/003; E05B 63/04; E05B 47/00; E05B 49/00; G07C 9/00817; E05Y 2900/132
USPC ..... 340/5.51, 5.32, 5.2, 5.54; 307/10.2; 70/278.1, 213
See application file for complete search history.

(56) References Cited

U.S. PATENT DOCUMENTS

| | | | | |
|---|---|---|---|---|
| 4,901,545 A * | 2/1990 | Bacon | G07C 9/0069 | 70/278.3 |
| 6,378,344 B1 * | 4/2002 | Gartner | E05B 47/0657 | 70/213 |
| 6,854,870 B2 * | 2/2005 | Huizenga | B60Q 1/2669 | 362/394 |

(Continued)

FOREIGN PATENT DOCUMENTS

| | | |
|---|---|---|
| CN | 1507602 A | 6/2004 |
| CN | 1982639 A | 6/2007 |

(Continued)

*Primary Examiner* — Nam V Nguyen
(74) *Attorney, Agent, or Firm* — Goldilocks Zone IP Law

(57) ABSTRACT

The present invention relates to an input device for a door lock, and specifically to an input device for a door lock wherein an input unit capable of recognizing a touch input and a push input at the same time is installed on a door lock lever. To this end, the input device for a door lock according to the present invention comprises: an input unit for generating an input signal by recognizing a touch input and a push input at the same time; and a door lock control unit for setting the door lock to a power-saving mode if the input signal is not received from the input unit for at least a predetermined period of time, and cancelling the power-saving mode if touch input signals are sequentially received from the input unit while the power-saving mode is set.

4 Claims, 5 Drawing Sheets

(56) References Cited

U.S. PATENT DOCUMENTS 7,400,232 B2 * 7/2008 Reichling ..... B60R 25/1001 16/110.1
7,911,321 B2 * 3/2011 Bingle ..... E05B 81/76 340/5.54
9,441,403 B2 * 9/2016 Kraus ..... E05B 85/16
9,574,375 B2 * 2/2017 Henderson ..... E05B 47/0001
2005/0090288 A1 * 4/2005 Stohr ..... H04M 1/23 455/566
2006/0065027 A1 * 3/2006 Valentine ..... E05B 47/0657 70/278.1
2008/0087797 A1 * 4/2008 Turnbull ..... B60Q 3/258 250/206.1
2010/0268426 A1 * 10/2010 Pathak ..... G06F 3/0482 701/48
2011/0181387 A1 * 7/2011 Popelard ..... B60R 25/246 340/5.2
2011/0289124 A1 * 11/2011 Denison ..... G07C 9/00571 707/812
2014/0047878 A1 * 2/2014 Zheng ..... E05B 47/0012 70/275
2015/0191948 A1 * 7/2015 Son ..... E05B 47/0673 292/336.3
2017/0011210 A1 * 1/2017 Cheong ..... G06F 21/32
2017/0280394 A1 * 9/2017 Kim ..... G06F 1/3265

FOREIGN PATENT DOCUMENTS

CN 104685141 A 6/2015
KR 20-0243685 Y1 8/2001
KR 20-0334250 Y1 11/2003
KR 10-0666071 B1 1/2007
KR 10-0886772 B1 3/2009
KR 10-2014-0017905 A 2/2014
KR 10-1417840 B1 7/2014
KR 10-2014-0118363 A 10/2014

* cited by examiner

INPUT DEVICE FOR DOOR LOCK

CROSS REFERENCE TO RELATED PATENT APPLICATION

This application claims the benefit under 35 U.S.C. Section 371, of PCT International Application No. PCT/KR2016/000683, Jan. 21, 2016 filed, the disclosures of which are hereby incorporated by the references.

BACKGROUND

Field

The present invention relates to an input device for a door lock, and specifically to an input device for a door lock wherein an input unit capable of recognizing a touch input and a push input at the same time is installed on a door lock lever.

Background Art

The electrically operated door locks are widely used because it is more inconvenient to open doors using a password or fingerprint input, while the mechanical door locks require users to carry keys.

The electrically operated door lock has a push button or a touch screen for input of passwords, and the user inputs the password by pressing the push button or touching the touch screen. In recent years, the touch screen is often adopted in the electrically operated door lock, for it provides convenience of inputting with light touches only and aesthetic appearance in design.

However, such a door lock with a touch screen requires a user make a touch input with his/her bare hand, since in most cases, a capacitance touch screen is used to increase the touch sensitivity. In winter, gloves are often worn, but users cannot make a touch input while wearing gloves, and therefore, there is inconvenient of having to take off gloves to make a touch input.

Most of the electrically operated door locks employ touch screens installed on a wall surface of the door as disclosed in Korean Patent Registration No. 0886772, but the designs of such door locks are limited and input interfaces that can provide new user experience are not provided.

DETAILED DESCRIPTION

Technical Problem

The present disclosure is designed to solve the problems mentioned above, and accordingly, it is an object of present disclosure to provide an input device for a door lock capable of a push input as well as a touch input.

It is another object of the present disclosure to provide an input device for a door lock, which is capable of providing a new user experience with a door lock input interface, by enabling an input unit of the door lock to be installed elsewhere rather than on a wall surface.

Technical Solution

To this end, an input device for a door lock according to the present disclosure may include: an input unit for generating an input signal by recognizing a touch input and a push input at the same time; and a door lock control unit for setting the door lock to a power-saving mode if the input signal is not received from the input unit for at least a predetermined period of time, and cancelling the power-saving mode if touch input signals are sequentially received from the input unit while the power-saving mode is set.

In an example, the input unit may include an upper input unit positioned on an upper portion of the door lock lever, and a lower input unit positioned on a lower portion of the door lock lever.

The input unit may include push buttons having a number and a sign marked thereon, and a touch sensor disposed on and around the push buttons.

Further, one of the push buttons may have a first terminal and a second terminal, and receive ID information from a master key upon contacting an input terminal of the master key with the first and second terminals, and transmit the received ID information to the door lock control unit.

The input device for a door lock according to present disclosure may further include a tilt sensor to recognize the upper and lower portions of the door lock lever, and the door lock control unit may use a signal generated from the tilt sensor to allow the input signal received from the upper input unit while ignoring a signal received from the lower input unit.

Further, an input device for a door lock according to the present disclosure may include a first array of buttons disposed on an upper portion of a door lock lever to recognize a touch input and a push input at the same time, a second array of buttons disposed on a lower portion of the door lock lever to recognize a touch input and a push input at the same time, a tilt sensor to recognize the upper and lower portions of the door lock lever, a door lock control unit that uses a signal from the tilt sensor to allow an input signal from the first array of buttons while ignoring an input signal from the second array of buttons, sets the door lock to a power-saving mode if the input signal is not received from the first array of buttons for at least a predetermined period of time, and cancels the power-saving mode if touch input signals are sequentially received from the first array of buttons while the power-saving mode is set.

Advantageous Effects

As described above, the input device for a door lock according to the present disclosure has an input unit capable of recognizing a touch and a push input at the same time, thus allowing the user to input password of the door lock regardless of whether or not he or she is wearing gloves.

According to the present disclosure, since the input unit capable of recognizing both the touch and push input at the same time is disposed on the door lock lever, there is no need for a separate touch screen and accordingly, the configuration of the door lock is simplified.

Also, since the input unit is provided side by side on the upper and portions of the door lock lever, the input device can be applied to the right-hand door or the left-hand door without need for a separate touch screen, and thus user can have new input experience.

In addition, an array of buttons capable of recognizing a touch input and a push input at the same time is disposed on a door lock lever, and power-saving mode is canceled upon performing a touch input on the array of buttons in sequence with a finger, which can give a new input experience to the user.

BEST MODE

Figure 1:
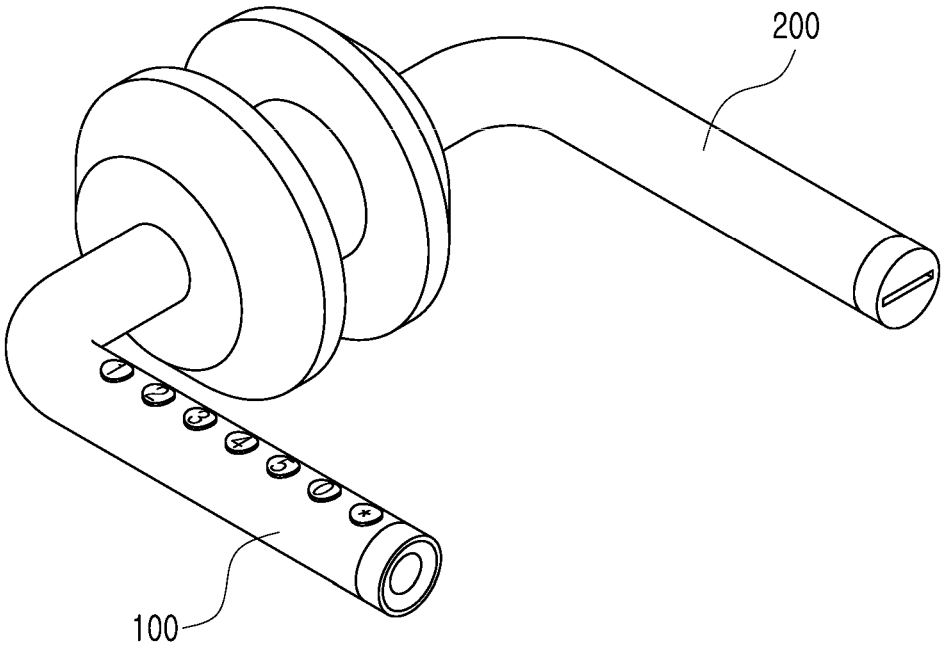
FIG. 1 is a view illustrating an appearance of a door lock according to an exemplary embodiment.

Hereinafter, embodiments of the present disclosure will be described in detail with reference to the accompanying drawings. The configuration of the present disclosure and operation and effect thereof will be clearly understood from the following detailed description.

Before describing the disclosure in detail, it is to be noted that the same elements are denoted by the same reference numerals even if they are illustrated in different drawings, and the detailed description of the known constitution will be omitted when it is considered to obscure the gist of the present disclosure.

Figure 2:
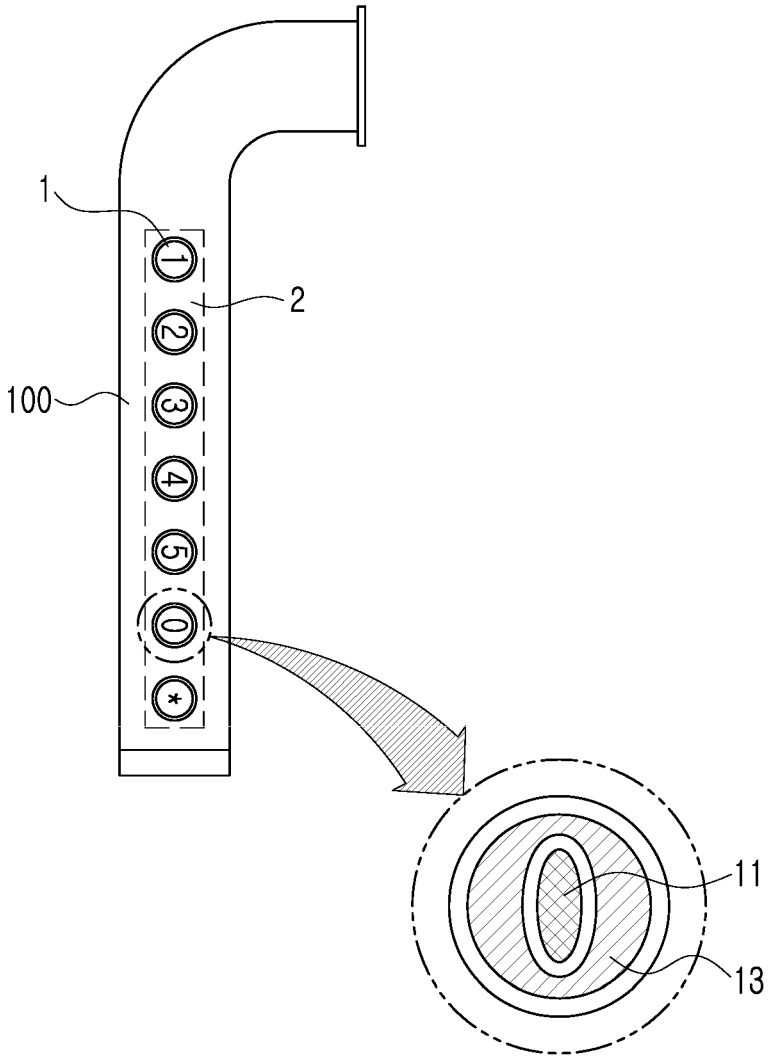
FIG. 2 is a view illustrating an appearance of an input device for a door lock according to an exemplary embodiment.

FIG. 1 is a view illustrating an appearance of a door lock according to an exemplary embodiment, and FIG. 2 is a view illustrating an appearance of an input device for a door lock according to an exemplary embodiment.

Referring to FIG. 1, the door lock includes an outer lever 100 installed outside the door, and an inner lever 200 installed inside the door, in which the outer lever 100 has an array of buttons installed thereon.

While FIG. 1 illustrates the array of buttons as being installed only on the upper portion of the outer lever 100, it is to be noted that the same array of buttons is also provided on a lower portion of the outer lever 100.

By installing the arrays of buttons on both the upper and lower portions of the outer lever 100, it is possible to apply the door lock according to the present disclosure to both the right-hand door and the left-hand door.

Meanwhile, in the configuration in which the arrays of buttons are installed on both the upper and lower portions of the outer lever 100, it is necessary to ensure that only the array of buttons on the upper portion is operated and not the array of buttons on the lower portion. To accomplish this, a tilt sensor (not shown) is built in the door lock, which allows a signal inputted from the array of buttons on the upper portion, while ignoring a signal inputted from the array of buttons on the lower portion.

The array of buttons is composed of a plurality of buttons 1, with each of the plurality of buttons being marked with numbers '0', '1', '2', . . . '5' and a sign '*'.

The array of buttons according to the present disclosure allows recognition of the touch input and the push input at the same time, and to accomplish this, a touch sensor 2 is installed above or around the push button 1. In an example, a capacitance type touch panel that detects a change in capacitance may be used as the touch sensor 2.

One of the push buttons 1 may be provided with a function of unlocking the door lock upon contacting a master key.

Referring to FIG. 2, the button '0' includes a first terminal 11 and a second terminal 13 and ID information may be received from the master key when the terminals 11 and 13 contact the input terminal of the master key. As can be seen in the enlarged illustration of the button '0', the button '0' is divided into the first terminal 11 in an area inside a number sign '0' and the second terminal 13 in an area outside the number sign '0'.

The other number buttons may likewise serve as the buttons that touch the master key, in which case the inner area of each number sign will be the first terminal and the outer area of the number sign will be the second terminal, as described above with reference to the example of the button '0'.

Figure 4:
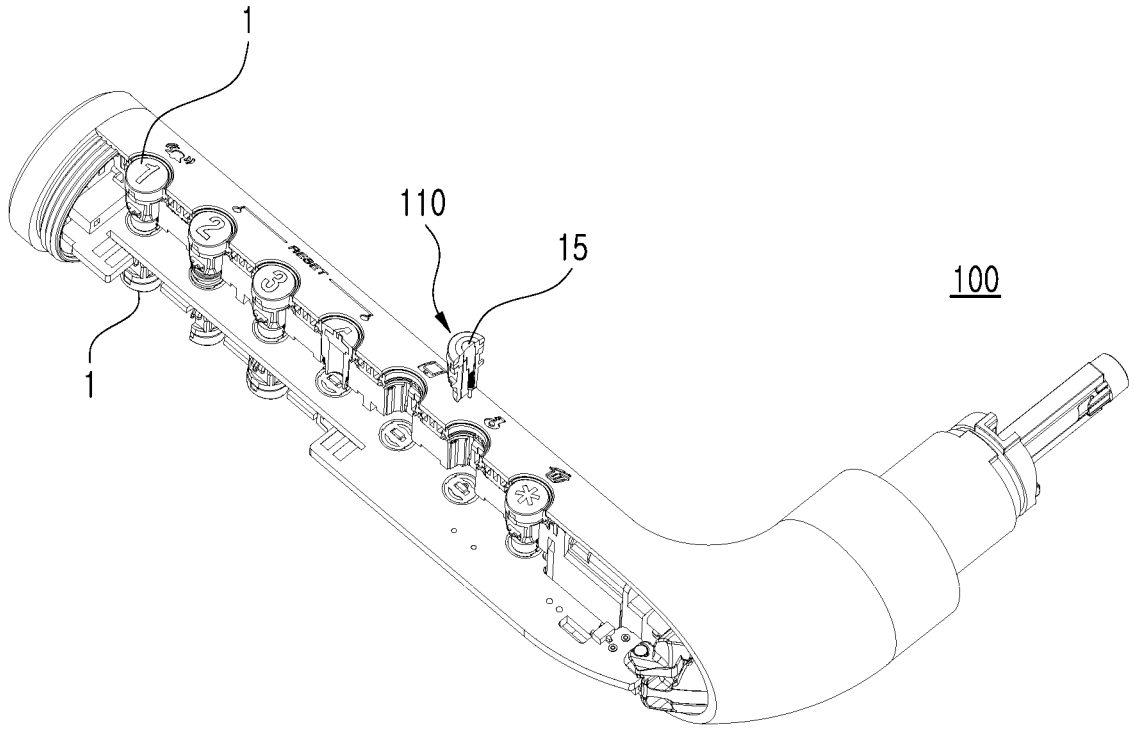
FIG. 4 is a view illustrating a button array structure of an input device for a door lock according to an exemplary embodiment.
Figure 5:
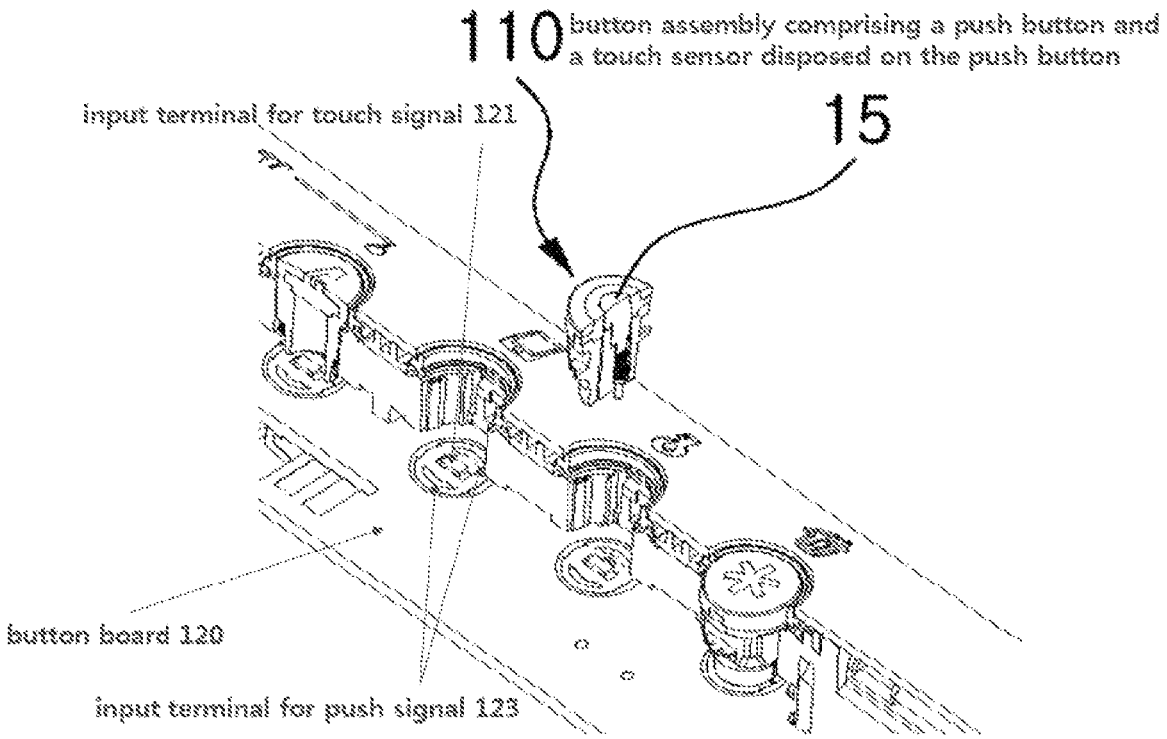
FIG. 5 is a partially enlarged view illustrating a button array structure of an input device for a door lock of FIG. 4 according to an exemplary embodiment.

The structure of the arrays of buttons of the outer lever 100 will be described in detail, with reference to FIGS. 4-5 illustrating the arrays of buttons installed on both the upper and lower portions of the outer lever 100.

A button board 120 is installed inside the outer lever 10. A plurality of input terminals comprising an input terminal 121 for touch signal and an input terminal 123 for push signal are disposed on the button board 120.

The arrays of buttons are installed on the input terminals of both the upper and lower portions of the button board 120. The each button of the array of buttons comprises a push button for push signal input and a touch sensor for touch signal input disposed on the push button Particularly, unlike the button assemblies for other numbers, a button assembly 110 for number '0' is provided with a contact terminal 15 to contact the input terminal of the master key. While the terminal to contact the input terminal of the master key is divided into an inner terminal and an outer terminal with reference to number sign '0' as a boundary in FIG. 2, in FIG. 4, the contact terminal 15 includes one terminal within the number sign '0'. It is to be noted, however, that the contact terminal 15 itself is divided into + and − terminals.

Figure 3:
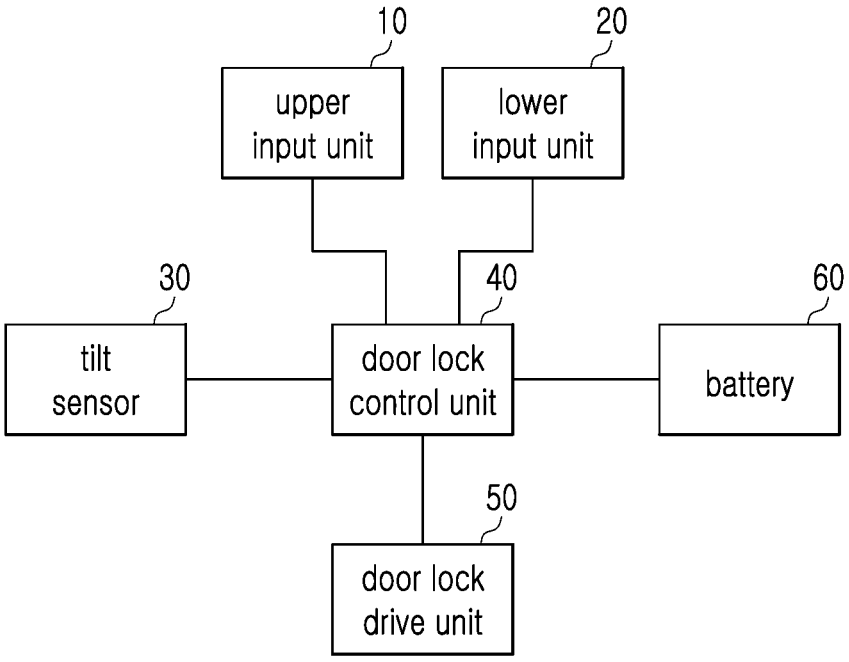
FIG. 3 is a view illustrating an inner configuration of an input device for a door lock according to an exemplary embodiment.

FIG. 3 is a view illustrating an inner configuration of an input device for a door lock according to an exemplary embodiment.

Referring to FIG. 3, an input device for a door lock includes an upper input unit 10, a lower input unit 20, a tilt sensor 30, a door lock control unit 40, a door lock drive unit 50, and a battery 60, for example.

The upper input unit 10 is a first array of buttons disposed on an upper portion of the outer lever 100 of the door lock, and divided into a push button and a touch sensor to enable recognition of a touch input and a push input at the same time.

Likewise, the lower input unit 20 is a second array of buttons disposed on a lower portion of the outer lever 100 of the door lock, and divided into a push button and a touch sensor to enable recognition of a touch input and a push input at the same time.

The tilt sensor 30 is a sensor responsive to tilting. The tilt sensor 30 according to the present disclosure is embedded in the outer lever 100 of the door lock to recognize the upper and lower portions of the outer lever 100. When the tilt sensor 30 is tilted by at least a predetermined angle, an internal contact may be ON or an electric signal proportional to the angle may be generated.

The door lock control unit 40 is provided to control the overall operation of the door lock.

The door lock control unit 40 according to the present disclosure uses the electric signal generated from the tilt sensor 30 to allow an input signal from the upper input unit 10 while ignoring an input signal from the lower input unit 20.

The door lock control unit 40 sets the door lock to the power-saving mode if the input signal is not received from the upper input unit 10 for at least a predetermined period of time, and cancels the power-saving mode if touch input signals are sequentially received from the upper input unit 10 while the power-saving mode is set. That is, a swipe signal is generated when the user touches and slides on the upper input unit 10 with his/her finger. The door lock control unit 40 cancels the power-saving mode when the swipe signal is received from the upper input unit 10.

The door lock drive unit 50 causes the door lock to be opened or closed according to a control command from the door lock control unit 40. The door lock control unit 40 outputs an open command to the door lock drive unit 50 when the password received from the upper input unit 10 matches, or outputs a close command to the door lock drive unit 50 when determining the door is closed.

The battery 60 is provided to supply electric power to the door lock. The battery can be either a battery or a secondary battery, and both the battery and the secondary battery may be used at the same time as a power source for the door lock.

In an example of using the input device for a door lock described above, when the user touches and slides his/her finger ("swipes") on a button of the array of buttons with the finger while the door lock is in the power-saving mode, the power-saving mode is cancelled, after which the user may input password by pushing or touching the array of buttons.

Also, when the user brings the terminal of the master key to a contact with the button '0', the door lock may be unlocked without requiring pressing of the password.

The foregoing description is merely illustrative of the present disclosure, and various modifications may be made by those skilled in the art without departing from the spirit of the present disclosure.

Accordingly, the embodiments disclosed herein are not intended to limit the present disclosure. The scope of the present disclosure should be construed by following claims, and every technical art within a same scope of the following claims should be construed to be included in a scope of a right of the present disclosure.

INDUSTRIAL APPLICABILITY

Present disclosure relates to an input device for a door lock and can be widely applied to digital door lock devices.

What is claimed is:

1. An input device for a door lock having a door lock lever, comprising:

a button board installed inside the door lock lever, wherein a plurality of input terminals comprising an input terminal for touch signal and an input terminal for push signal are disposed on the button board;

an array of buttons installed on the input terminals of the button board to comprise a push button for push signal input and a touch sensor for touch signal input disposed on the push button; and a door lock control unit that sets the door lock to a power-saving mode if an input signal is not received from the array of buttons for a predetermined period of time, and cancels the power-saving mode only if a swipe signal generated when touching and sliding on the array of buttons with a finger is received from the array of buttons while the power-saving mode is set.

2. The input device of claim 1, wherein one of the push buttons has a first terminal and a second terminal, and receives ID information from a master key upon contacting an input terminal of the master key with the first and second terminals, and transmit the received ID information to the door lock control unit.

3. The input device of claim 2, wherein a button '0' of the push buttons has the first terminal and the second terminal, with the first terminal being in an area inside a number sign '0' and the second terminal being in an area outside the number sign '0'.

4. A door lock device, comprising:

a button board installed inside a door lock lever, wherein a plurality of input terminals comprising an input terminal for touch signal and an input terminal for push signal are disposed on an upper portion and a lower portion of the button board;

a first array of buttons installed on the input terminals of the upper portion of the button board to comprise a push button for push signal input and a touch sensor for touch signal input disposed on the push button;

a second array of buttons installed on the input terminals of the lower portion of the button board to comprise a push button for a push signal input and a touch sensor for a touch signal input disposed on the push button;

a tilt sensor to recognize the upper and lower portions of the door lock lever; and a door lock control unit that uses a signal from the tilt sensor to allow an input signal from the first array of buttons while ignoring an input signal from the second array of buttons, sets the door lock device to a power-saving mode if an input signal is not received from the first array of buttons for a predetermined period of time, and cancels the power-saving mode only if a swipe signal generated when touching and sliding on the first array of buttons with a finger is received from the first array of buttons while the power-saving mode is set.

* * * * *